US005820411A

United States Patent [19]

Okabe

[11] Patent Number: 5,820,411

[45] Date of Patent: Oct. 13, 1998

[54] CONNECTOR

[75] Inventor: Toshiaki Okabe, Shizuoka, Japan

[73] Assignee: Yazaki Corporation, Tokyo, Japan

[21] Appl. No.: 872,137

[22] Filed: Jun. 10, 1997

[30] Foreign Application Priority Data

Jun. 10, 1996 [JP] Japan ..... 8-147545

[51] Int. Cl.[6] ..... M01R 13/40

[52] U.S. Cl. ..... 439/595

[58] Field of Search ..... 439/595, 744

[56] References Cited

U.S. PATENT DOCUMENTS

| | | | |
|---|---|---|---|
| 5,176,537 | 1/1993 | Samejima et al. | 439/595 |
| 5,607,327 | 3/1997 | Tsuji et al. | 439/752 |
| 5,746,624 | 5/1998 | Ohsumi et al. | 439/595 |

*Primary Examiner*—Neil Abrams
*Assistant Examiner*—T. C. Patel
*Attorney, Agent, or Firm*—Sughrue, Mion, Zinn, Macpeak & Seas, PLLC

[57] ABSTRACT

A connector including a connector housing having at least one terminal receiving chamber and a lock lance provided in the terminal receiving chamber for locking a terminal to prevent the terminal from coming off from the terminal receiving chamber, and a front holder inserted from a holder insertion port formed at a front end of the connector housing so that a forward end portion of the front holder is plugged into a bending space of the lock lance to thereby prevent the lock lance from bending in a direction of disengagement. In the connector, the front holder is designed so as to be positioned selectively in a normal lock position where the forward end portion is plugged into the bending space of the lock lance or in a temporary lock position where the forward end portion is not plugged. Also, the front holder has a terminal contact portion which constitutes a portion of a circumferential wall of the terminal receiving chamber when the front holder is in the normal lock position, and a jig insertion slot provided in an outside surface of the terminal contact portion so as to extend from one end on a side of the holder insertion port to the other end on a side of the lock lance.

2 Claims, 3 Drawing Sheets

CONNECTOR

BACKGROUND OF THE INVENTION

1. Field of the Invention

The present invention relates to a connector used for a wire harness of an automobile or the like, and particularly to a connector using a front holder to thereby double-lock a terminal inserted to a connector housing.

2. Description of the Related Art

Conventionally, a connector for double-locking a terminal inserted to a connector housing has a front holder to be inserted from the front end of the connector housing.

A terminal receiving chamber is provided in the connector housing so that the terminal is inserted from the rear end thereof. A lock lance is provided at the circumferential wall of the terminal receiving chamber so that the lance is bent and transformed as the terminal is inserted, while it returns to its original position so as to perform lock to prevent the terminal from coming off in a state where the terminal has been inserted in a predetermined position.

The front holder is inserted from a holder insertion port at the front end of the connector housing, and the forward end-portion is plugged into a bending space of the lock lance, so as to prevent the lock lance from bending to thereby perform double-lock of the terminal to the connector housing. Further, this front holder cannot be plugged into the bending space in the state in which the lock lance is bending, so that the state of half-insertion of the terminal can be detected on the basis of the fact that the front holder cannot be plugged in.

Incidentally, when the terminal inserted into the terminal receiving chamber is to be removed from the connector housing at the time of maintenance or the like, it is necessary to force the lock lance to bend in the direction to make the lock lance disengage from the terminal by means of a removal jig. However, in the conventional connector as mentioned above, the front of the bending space of the lock lance is closed by the front holder, so that if the front holder is not perfectly removed, the forward end of the removal jig cannot be inserted into the lock lance. Therefore, in such a connector, there has been a fear of loss or damage of the front holder.

Therefore, a connector in which a lock lance can be removed even if a front holder is not perfectly removed is disclosed in Japanese Patent Unexamined Publication No. Hei. 7-282884, etc.

A connector 21 shown in FIGS. 5 and 6 is designed to have a connector housing 22 and a front holder 23 so that a terminal 5 is prevented from being detached by a lock lance 28 in the state in which the terminal 5 is inserted in a terminal receiving chamber 27 of the connector housing 22. The front holder 23 is inserted from a holder insertion port 29 at the front end of the connector housing 22, and the forward end portion is plugged into a bending space 26 of the lock lance 28, so as to prevent the lock lance 28 from bending in the direction of disengagement to thereby perform double-locking of the terminal 5 to the connector housing 22.

The front holder 23 has an insertion slot 24 through which a removal jig 15 can be inserted into the lock lance 28 in the state in which the front holder 23 is in a temporary lock position, and a jig hanging portion 25 at the front end of the insertion slot 24. If the removal jig 15 plugged from the insertion slot 24 is operated using the jig hanging portion 25 as a fulcrum, it is possible to force the lock lance 28 to bend.

However, since it is necessary to make the connector 21 pass the portion where the front end portion of the terminal 5 is exposed when the removal jig 15 is inserted as shown in FIG. 6, there has been a fear that the removal jig 15 pries an electric connection portion of the terminal 5 by mistake, etc., to thereby injure or transform the connection portion.

SUMMARY OF THE INVENTION

It is therefore an object of the present invention to solve the foregoing problems.

It is another object of the present invention to provide a connector having a compact structure in which a terminal can be taken out without perfectly removing a front holder, and the workability of taking-out the terminal can be improved without injuring or deforming the terminal.

In order to achieve the above objects, the present invention provides a connector comprising: a connector housing having a terminal receiving chamber, and a lock lance provided in the terminal receiving chamber for locking a terminal to prevent the terminal from coming off from the terminal receiving chamber; and a front holder inserted from a holder insertion port formed at a front end of the connector housing so that a forward end portion of the front holder is plugged into a bending space of the lock lance to thereby prevent the lock lance from bending in a direction of disengagement, wherein the front holder is designed so as to be positioned selectively in a normal lock position where the forward end portion is plugged into the bending space of the lock lance or in a temporary lock position where the forward end portion is not plugged, and the front holder has a terminal contact portion which constitutes a portion of a circumferential wall of the terminal receiving chamber when the front holder is in the normal lock position, and a jig insertion slot provided in an outside surface of the terminal contact portion so as to extend from one end on a side of the holder insertion port to the other end on a side of the lock lance.

DETAILED DESCRIPTION OF THE PREFERRED EMBODIMENT

An embodiment of the present invention will be described in detail with reference to the accompanying drawings.

Figure 1:
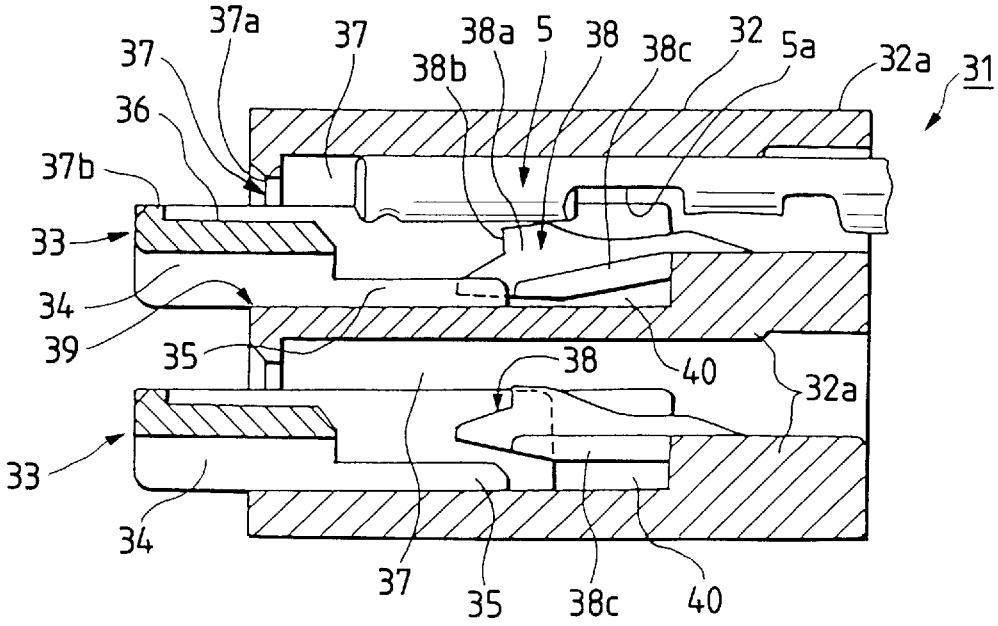
FIG. 1 is a sectional view of a main part of an embodiment of the connector according to the present invention, showing the state where a terminal is in a way of insertion.
Figure 2:
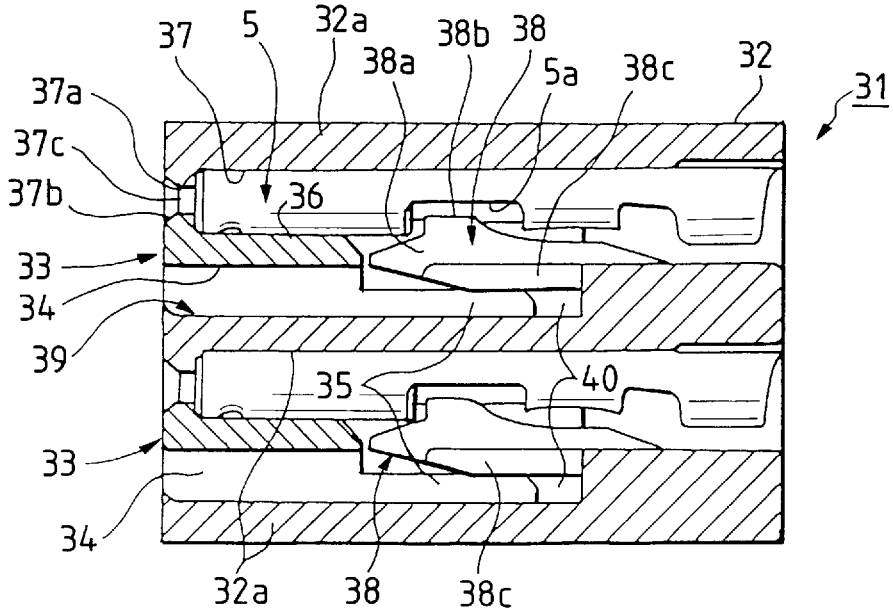
FIG. 2 is a sectional view illustrating the main part of the connecter of FIG. 1, showing the state after the terminal has been inserted.
Figure 3:
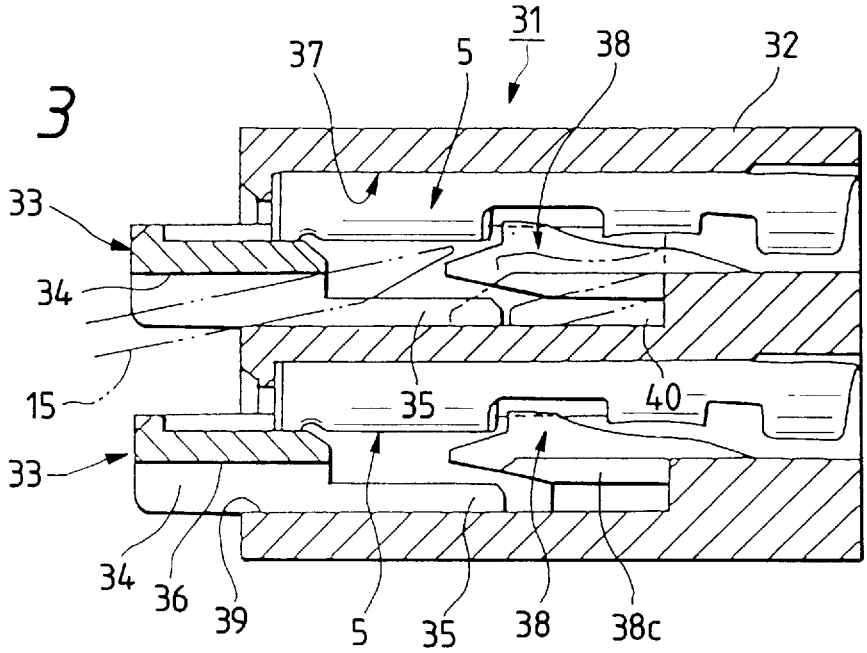
FIG. 3 is a sectional view illustrating the main part of the connecter of FIG. 1, showing the state where the terminal is in a way of being taken out.
Figure 4:
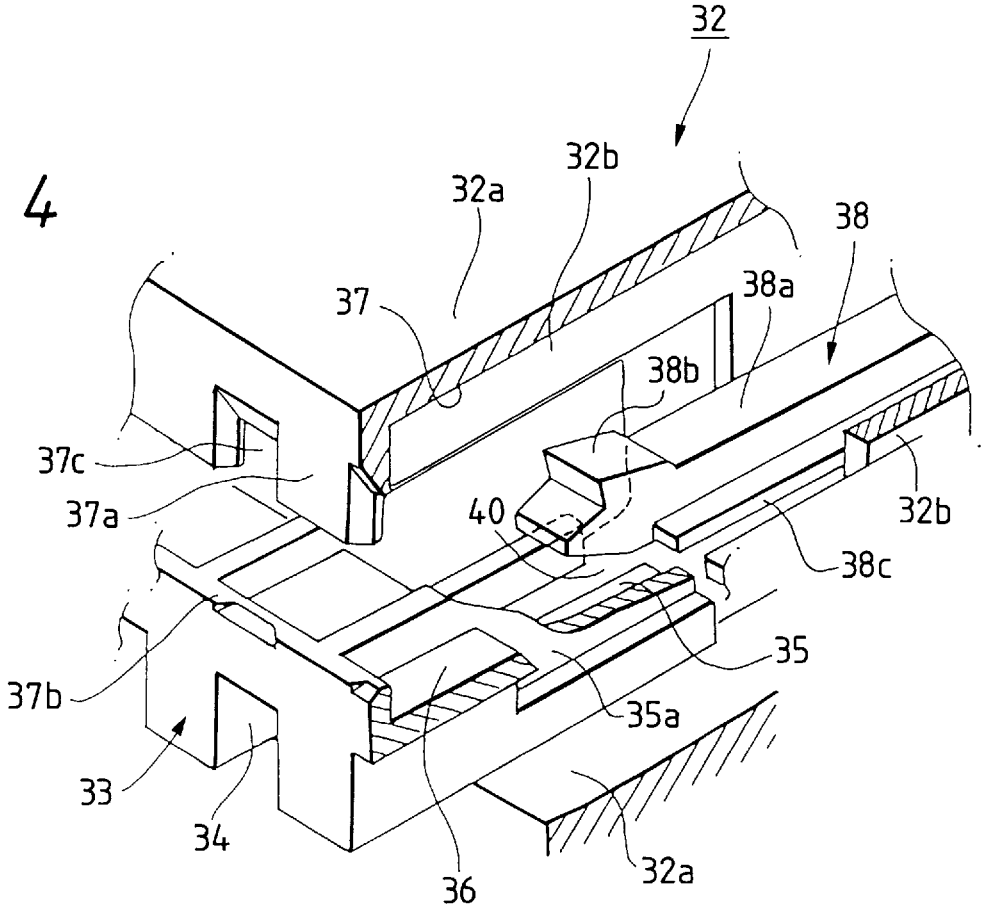
FIG. 4 is a schematic perspective view. of the connector of FIG. 1 with the main part broken away in a front holder temporary lock state.
Figure 5:
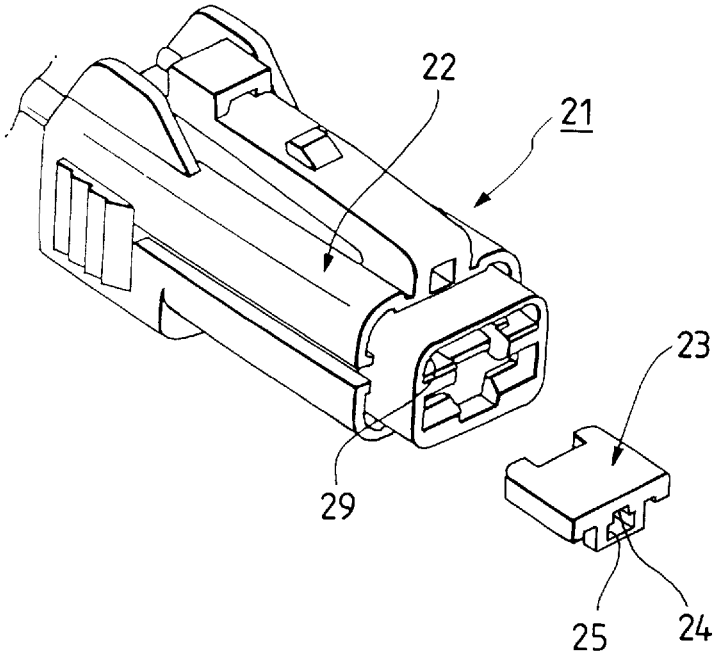
FIG. 5 PRIOR ART
FIG. 5 is a perspective view illustrating the appearance of a conventional connector.
Figure 6:
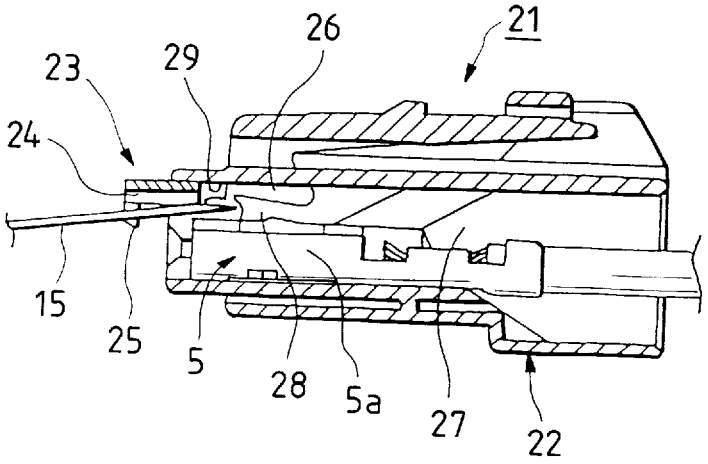
FIG. 6 PRIOR ART
FIG. 6 is a sectional view illustrating the connector of FIG. 5, showing the state where a terminal is in a way of being taken-out.

FIGS. 1 to 3 are sectional views showing different states of a connector 31 according to the present invention, and FIG. 4 is a schematic perspective view of the connector 31 in a front holder temporary lock state.

The connector 31 has a connector housing 32 and front holders 33. The internal space of the connector housing 32 is sectioned into a plurality of spaces arranged vertically and horizontally by vertical and horizontal partition walls 32*a* and 32*b*, and terminal receiving chambers 37 are defined in the spaces respectively. Each terminal receiving chamber 37 is formed so as to penetrate so that a terminal 5 can be inserted from the rear end of the housing, and a partner terminal can be inserted from the front end of the housing. Most of the circumferential wall of the terminal receiving chamber 37 except a portion thereof is constituted by the partition walls 32*a* and 32*b*, and the rest portion, that is, a front end bottom wall of the terminal receiving chamber 37 is constituted by a terminal contact portion 36 of the front holder 33.

As shown in FIG. 1, a flexible lock lance 38 is provided on the bottom wall of each terminal receiving chamber 37, so that the flexible lock lance 38 is bent and transformed downward as the terminal 5 is inserted, while it returns to its original position in the state where the terminal 5 has been inserted in a predetermined position so as to lock the terminal 5 to prevent the terminal 5 from being coming off. In the lock lance 38, a lock protrusion 38*b* which fits to a lance engagement portion 5*a* of the terminal 5 is provided so as to project over the upper surface of the forward end of a lock lance body 38*a* at the center in the width direction, and protrusion portions 38*c* are provided so as to project on the opposite sides of the lock lance body 38*a*.

The front holder 33 is inserted from a holder insertion port 39 at the front end of the connector housing 32, and a forward end portion 35 is plugged into a bending space 40 of the lock lance 38 so as to prevent the lock lance 38 from bending in the direction of disengagement to thereby perform double-locking of the terminal 5 to the connector housing 32. In the case of this embodiment, the forward end portion 35 of the front holder 33 prevents the lock lance 38 from bending in the direction of disengagement correspondingly to the protrusion portions 38*c* of the lock lance 38.

By a not-shown lock mechanism, the front holder 33 is designed so as to be positioned in a normal lock position where the forward end portion 35 is plugged into the bending space 40 of the lock lance 38, and in a temporary lock position where the forward end portion 35 is not plugged. That is, FIGS. 1 and 3 show the state where the front holder 33 is in the temporary lock position, and FIG. 2 shows the state where the front holder 33 is in the normal lock position.

The terminal contact portion 36 of the front holder 33 constitutes a portion of the circumferential wall of the terminal receiving chamber 37, and, in its external surface (lower surface in the drawings), the terminal contact portion 36 has a jig insertion slot 34 which extends from one end portion on the side of the terminal holder insertion port 39 to the other end portion on the side of the lock lance 38.

The forward end portions 35 are shifted to the opposite sides from the position corresponding to the lock lance body 38*a* of the lock lance 38 so as to be arranged in pair correspondingly to the respective protrusion portions 38*c*. A space defined by the jig insertion slot 34 is formed in the position corresponding to the lock lance body 38*a*.

In addition, as shown in FIG. 4, a side wall 35*a* constituting a portion of the circumferential wall on a side of the terminal receiving chamber 37 is provided on the forward end portion 35 of the front holder 33. Front end walls 37*a* and 37*b* functioning as a front stopper for the terminal 5 and forming a receiving hole 37*c* for receiving a partner connector terminal are provided at the front end of the connector housing 32 and at the front end of the front holder 33 respectively.

Next, the operation of the connector 31 will be described.

To assemble the terminal (female terminal herein) 5 in the connector housing 32, the terminal 5 is inserted from the rear of the terminal receiving chamber 37 as shown in FIG. 1. As the terminal 5 is inserted, the lock lance 38 is pushed by the terminal 5, and bent and transformed down to the bending space 40. When the terminal 5 is further inserted, as shown in FIG. 2, the lock lance 38 returns to its original position, and the engagement protrusion 38*b* of the lance 38 fits to the lance engagement portion 5*a* of the terminal 5, so that the terminal 5 is prevented from coming off backward. In this state, the front holder 33 kept in the temporary lock position in FIG. 1 in advance is inserted to the normal lock position in the connector housing 32, and the forward end portion 35 is plugged into the bending space 40 as shown in FIG. 2. Consequently, the lock lance 38 is prevented from being bent and transformed by the forward end portion 35, so that the terminal 5 is double-locked.

If the terminal 5 is in the half-insertion state as shown in FIG. 1 when the front holder 33 is inserted to the normal lock position, the protrusion portions 38*c* of the lock lance 38 transformed into the bending space 40 contacts with the forward end portion 35 so as to block the entrance of the front holder 33, so that the front holder 33 cannot be plugged anymore. Therefore, by this fact, it can be detected that the terminal 5 is in the half-insertion state.

On the other hand, when the terminal 5 inserted and attached to the terminal receiving chamber 37 is taken out, the front holder 33 is drawn to the temporary lock position as shown in FIG. 3. In this state, the forward end of the removal jig 15 is plugged in from the jig insertion slot 34 of the front holder 33, and the removal jig 15 is operated while using one end portion of the terminal contact portion 36 as a fulcrum. In the temporary lock state of the front holder 33, the protrusion portions 38*c* of the lock lance 38 do not contact with the forward end portions 35, so that bending and transformation of the lock lance 38 are not prevented. Therefore, the lock lance 38 can be forced to bend by the removal jig 15 so that the terminal 5 is taken out backward in this state.

That is, in the connector 31, with the jig insertion slot 34 provided in the front holder 33, the lock lance 38 can be forced to bend by the removal jig 15 in the state where the front holder 33 is positioned in the temporary lock position, that is, in the state where the front holder 33 is not perfectly taken out. It is therefore possible to prevent the front holder 33 from being lost or deformed.

In addition, because the terminal contact portion 36 exists as a partition wall between the jig insertion slot 34 and the terminal 5 when the removal jig 15 is operated, it is difficult for the removal jig 15 to contact with the terminal 5, so that it is possible to prevent the terminal 5 from being injured or deformed.

Further, the terminal contact portion 36 is provided so as to constitute a portion of the circumferential wall of the terminal receiving chamber 37, and the circumferential wall on the side of the connector housing 32 can be omitted correspondingly so as to miniaturize the connector housing 32. It is therefore possible to apply the present invention easily to a small-sized connector with a small pitch.

Further, the protrusion portions 38*c* provided so as to project on the opposite sides of the lock lance body 38*a* engages with the forward end portions 35 located on the opposite sides of the jig insertion slot 34 so as to prevent the lock lance 38 from bending in the direction of disengagement. Accordingly, it is possible to set the width of the jig insertion slot 34 to be wider than the width of the lock lance body 38*a*, so that it is possible to ensure an enough width which is necessary for inserting the removal jig 15 even when the present invention is applied to a small-sized connector.

A connector according to the present invention is not limited to the structure in the above embodiment, and, not to say, can be modified variously.

As has been described above, according to the connector of the present invention, even if the front holder is not perfectly taken out, it is possible to force the lock lance to bend to take out the terminal. At that time, since the terminal contact portion formed in the front holder exists between the insertion portion of the removal jig and the terminal, it is difficult for the removal jig to contact with the terminal so that there is no fear that the terminal is injured or deformed.

In addition, the terminal contact portion is provided to constitute a portion of the circumferential wall of the terminal receiving chamber, and the circumferential wall on the side of the connector housing is omitted correspondingly so as to miniaturize the connector housing, so that it is possible to apply the present invention easily to a small-sized connector with a small pitch.

Further, since the protrusion portions provided so as to project on the opposite sides of the lock lance body engage with forward end portions located on the opposite sides of the jig insertion slot so as to prevent the lock lance from bending in the direction of disengagement, it is possible to set the width of the jig insertion slot to be larger than the width of the lock lance body, so that it is possible to ensure an enough slot width which is necessary for inserting the removal jig even in the case of application to a small-sized connector.

It is therefore possible to provide a connector having a compact structure in which it is possible to taken out the terminal without perfectly removing the front holder, and the workability of taking out the terminal can be improved without injuring or deforming the terminal.

What is claimed is:

1. A connector comprising:

a connector housing having a terminal receiving chamber, and a lock lance provided in said terminal receiving chamber for locking a terminal to prevent said terminal from coming off from said terminal receiving chamber; and a front holder inserted from a holder insertion port formed at a front end of said connector housing so that a forward end portion of said front holder is plugged into a bending space of said lock lance to thereby prevent said lock lance from bending in a direction of disengagement, wherein said front holder is designed so as to be positioned selectively in a normal lock position where the forward end portion is plugged into the bending space of said lock lance or in a temporary lock position where the forward end portion is not plugged, and said front holder has a terminal contact portion which constitutes a portion of a circumferential wall of said terminal receiving chamber when said front holder is in the normal lock position, and a jig insertion slot provided in an outside surface of said terminal contact portion so as to extend from one end on a side of said holder insertion port to the other end on a side of said lock lance.

2. The connector according to claim 1, wherein a width of said jig insertion slot is formed to be larger than a width of said lock lance, and a protrusion portion is provided on a side of a body of said lock lance so as to project therefrom, so that said protrusion portion engages with the forward end portion of said front holder to prevent said lock lance from bending in the direction of disengagement when said front holder is in the normal lock position.

* * * * *